United States Patent [19]

Brady et al.

[11] 4,122,419

[45] Oct. 24, 1978

[54] TUNABLE RESONANT CAVITIES HAVING PARTICULAR ISOLATING CHOKE

[75] Inventors: Michael Barry Clive Brady, Maldon; David William Bennett, Writtle, all of England

[73] Assignee: English Electric Valve Company Limited, Chelmsford, England

[21] Appl. No.: 783,621

[22] Filed: Apr. 1, 1977

[30] Foreign Application Priority Data

Apr. 9, 1976 [GB] United Kingdom ..... 14704/76

[51] Int. Cl.[2] ..... H01P 7/06; H01J 25/50

[52] U.S. Cl. ..... 333/83 R; 315/39.61

[58] Field of Search ..... 333/83 R; 315/39.61

[56] References Cited

U.S. PATENT DOCUMENTS

| | | | |
|---|---|---|---|
| 2,611,110 | 9/1952 | Powers | 315/39.61 |
| 2,657,334 | 10/1953 | West | 315/39.61 |
| 2,807,745 | 9/1957 | Moll | 333/83 R X |
| 3,125,734 | 3/1964 | Ward | 333/83 R |
| 3,885,221 | 5/1975 | Lewis | 333/83 R |

*Primary Examiner*—Paul L. Gensler

*Attorney, Agent, or Firm*—Diller, Brown, Ramik & Wright

[57] ABSTRACT

The invention relates to a resonant cavity device such as a magnetron oscillator which is tunable by means of a tuning plunger associated with sealing bellows. A volume defined at least in part by the bellows and producing a range of spurious responses as the tuning plunger is moved is isolated from the resonant cavity or cavities of the device by an isolating choke. The choke may take the form of an annulus having a major radius of $\frac{1}{4}\lambda$ (where $\lambda$ is the mid-frequency of the tuning range) attached either to the plunger or to the main body of the device and between the bellows and the resonant cavity or cavities.

9 Claims, 2 Drawing Figures

TUNABLE RESONANT CAVITIES HAVING PARTICULAR ISOLATING CHOKE

Figure 1:
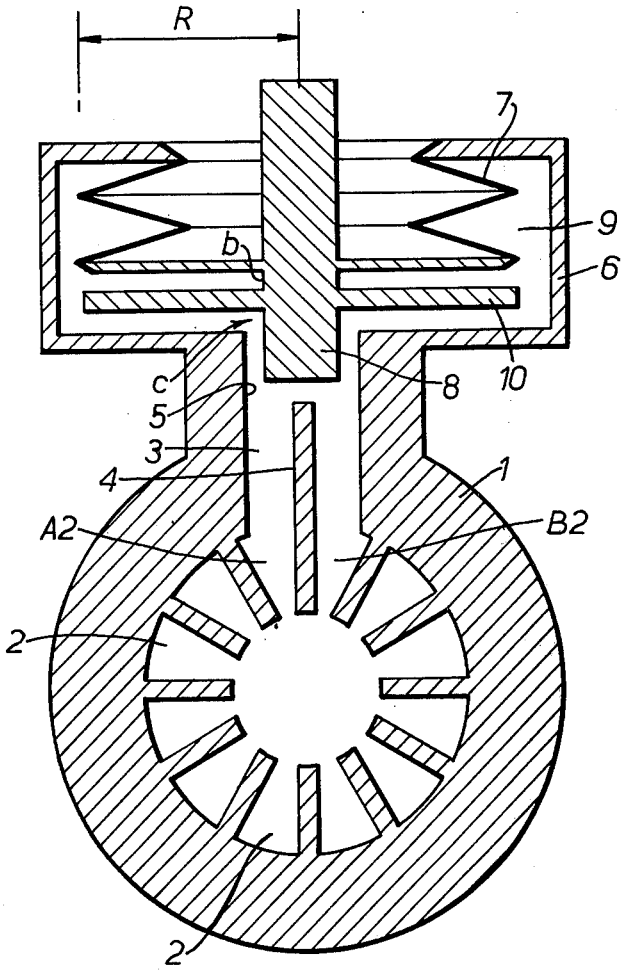

This invention relates to tunable resonant cavity devices and in particular to tunable resonant cavity devices in which a movable plunger or piston is utilised to influence the resonant frequency of the device.

In some examples of tunable resonant cavity devices, the plunger or piston may be arranged to act directly upon a cavity of the device, whilst in other examples, the tuning piston or plunger is coupled to a cavity, or cavities, of the device by means of a transmission path. In the specification of our U.S. Pat. No. 3,885,221, for example, is disclosed a resonant cavity device, such as a cavity magnetron, having a plurality of resonant cavities in a common block at least two adjacent ones of which exhibit in operation magnetic fields of opposing phase and wherein coupling to or from said device is effected by a co-axial transmission line formed by an annular hole of at least substantially constant cross-sectional dimensions extending into said block such that a portion of the annular hole to which one side of the inner wall forming member breaks into one of said two cavities and a portion of the annular hole to the opposite side of said inner wall forming member breaks into the other of said two cavities. In one embodiment of the above described prior invention means are provided for varying the value of reactance presented by the transmission line to said two cavities where they communicate with the transmission line, in order to effect tuning of said device, said last mentioned means preferably comprising a conductive cylinder provided to extend the outer wall of said annular hole away from said two cavities beyond the inner wall forming member and a tuning piston is provided in said cylinder adjustable to move towards or away from the end of said inner wall forming member.

In tunable resonant cavity devices as described above in which a tuning plunger or piston effects tuning, it is usual to provide some form of bellows to provide a seal for the moving plunger or piston. The result of this is that as tuning of the device is effected by movement of the tuning plunger, or piston, a volume defined at least in part by the bellows and coupled to the resonant cavity or cavities of the device, changes. This volume defined by the bellows will itself have a resonance associated with it. In practice, it has been found difficult to ensure that resonances associated with the volume defined by the bellows and the frequencies over which the resonant cavity device is tunable, do not coincide at one or more tuner settings. If such coincidence does occur, it is quite likely to cause a kink to appear in the tuning curve and, where high power resonant cavity devices are involved, heating of the tuner mechanism can occur which may result in the bellows being punctured.

In practice, attempts have been made to reduce the aforementioned volume defined by the bellows so far as is practicable. However, there is a practical limitation to the extent to which this volume can be reduced in view of practical limitations associated with the manufacture of the smallest sizes of bellows.

The present invention seeks to provide an improved resonant cavity device, and in particular an improved resonant cavity device as claimed in our co-pending U.S. Pat. No. 3,885,221 in which tuning is effected by means of a tuning plunger or piston which is sealed by means of a bellows, wherein the above difficulty is mitigated.

According to this invention, a resonant cavity device including a tuning plunger or piston and sealing bellows associated therewith is provided wherein a volume defined by at least in part said bellows, and producing a range of spurious resonances as said tuning plunger or piston is moved, is isolated from the resonant cavity or cavities of the said resonant device by means of an isolating choke.

Preferably, said resonant cavity device is in accordance with claim 5 of our prior U.S. Pat. No. 3,885,221.

Said isolating choke may comprise an annulus attached to said plunger or piston between said bellows and the resonant cavity or cavities of said device.

Said isolating choke may also comprise an annulus fixed in relation to the main body of said resonant device and between said bellows and the resonant cavity or cavities within said main body, said tuning plunger or piston being arranged to move through the aperture in said annulus.

Preferably said annulus is provided to have a major radius of substantially $\frac{1}{4}\lambda$, where $\lambda$ is the mid-frequency of the frequency range over which said device may be tuned.

Figure 2:
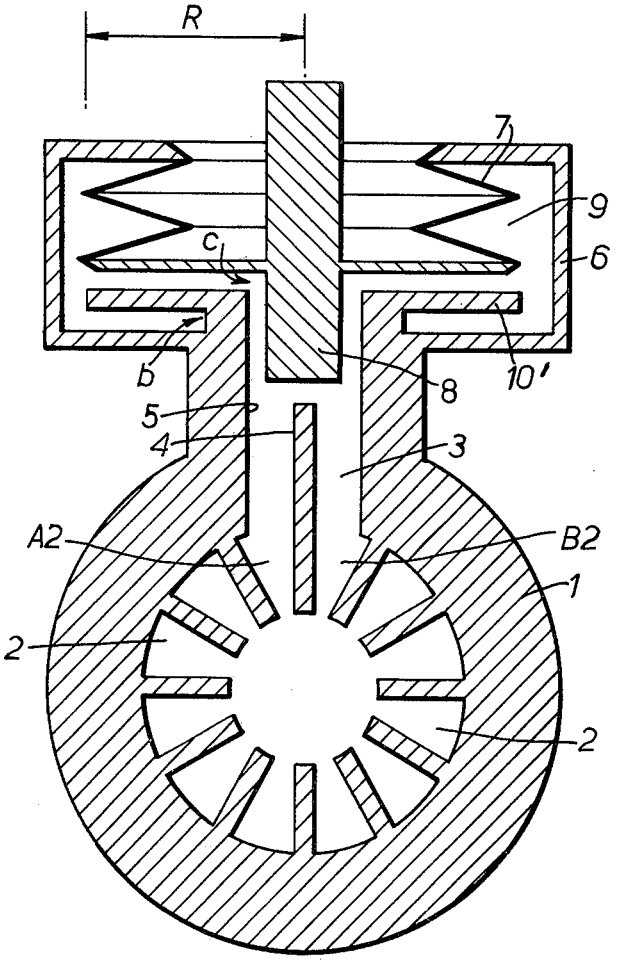

The invention is illustrated in and further described with reference to the accompanying drawings in which, FIGS. 1 and 2 are cross-sections of two different magnetron arrangements in accordance with the present invention in which tuning is effected in principle in the manner described with reference to FIG. 4 of the drawings accompanying the specification of our earlier U.S. Pat. No. 3,885,221.

Referring to FIG. 1, in accordance with normal practice the magnetron is provided with an anode block 1 having therein a plurality of resonant cavities, such as those referenced 2. As is well known, in operation alternate cavities exhibit magnetic fields of opposite phase. Thus of the two adjacent cavities referenced 2 to which the prefix "A" and "B" have been added, the magnetic field of cavity A2 may be taken to be directed into the plane of the drawings, whilst the magnetic field of cavity B2 may be taken to be directed out of the plane of the drawings as viewed.

In order to provide energy coupling with the magnetron, an annular hole 3 is provided to extend into an anode block 1 to communicate with the two cavities A2 and B2, in the manner described in detail in the specification of our prior U.S. Pat. No. 3,885,221. The inner wall forming member 4 of annular hole 3 and the outer wall 5 form respectively the central conductor and the outer conductor of a co-axial transmission line.

The outer walls 5 of the transmission line are extended beyond the inner conductor formed by inner wall forming member 4 and open out to form a chamber 6, sealed against the atmosphere by a bellows arrangement 7.

Passing through the bellows arrangement 7 is a tuning plunger represented at 8. The tuning plunger 8 extends towards the end of inner wall forming member 4 and may be moved there towards or there away from in order to vary the reactances of the end of the transmission line remote from the resonant cavities A2 and B2. With the length of the transmission line chosen appropriately, this variable reactance is transformed into a variable reactance at the end of the transmission line where it communicates with the resonant cavities A2 and B2, thus varying the frequency of these cavities to effect tuning of the magnetron.

In order to isolate the spurious resonances associated with the volume 9 defined in part by the bellows arrangement 7, an annular isolating choke 10 is mounted on tuning plunger 8 between the bellows arrangement 7 and the co-axial transmission line 4, 5. The annular isolating choke 10 has a major radius R, which is substantially equal to $\lambda/4$, where $\lambda$ is the mid frequency of the range of frequencies over which the magnetron is tunable as tuning plunger 8 is moved towards or away from inner wall forming member 4.

The isolating effect achieved by the annular isolating choke 10 is due to fact that the short circuit at point *b* is reflected to point *c*, a distance $\lambda/2$ away. Thus, very little r.f. current appears at the outer edge of the annular isolating choke arrangement, which inhibits r.f. energy from being coupled into the volume 9.

Referring to FIG. 2, in this example the annular isolating choke 10' is carried, not by tuning plunger 8, but by the extended outer wall of the transmission line. Again due to the fact that the short circuit at point *b* is transferred to point *c*, very little r.f. current appears at the outer edge of the annular isolating choke so that little or no r.f. energy can couple into the volume 9.

We claim:

1. A resonant cavity device having at least one resonant cavity and including a tuning plunger and sealing bellows associated therewith wherein a volume defined by at least in part said bellows, and producing a range of spurious resonances as said tuning plunger is moved, is isolated from said at least one resonant cavity of the said resonant device by means of an isolating choke comprising an annulus extending transversely to the direction of movement of said tuning plunger.

2. A device as claimed in claim 1 and wherein said annulus is attached to said plunger between said bellows and said at least one resonant cavity of said device.

3. A device as claimed in claim 1 and wherein said annulus is fixed in relation to the main body of said resonant device and between said bellows and said at least one resonant cavity within said main body, said tuning plunger being arranged to move through the aperture in said annulus.

4. A device as claimed in claim 2 and wherein said annulus is provided to have a major radius of substantially $\frac{1}{4}\lambda$, where $\lambda$ is the mid frequency of the frequency range over which said device may be tuned.

5. A device as claimed in claim 3 and wherein said annulus is provided to have a major radius of substantially $\frac{1}{4}\lambda$, where $\lambda$ is the mid frequency of the frequency range over which said device may be tuned.

6. A device as claimed in claim 1 and wherein said device is a magnetron oscillator.

7. In a resonant cavity device having at least one resonant cavity, a co-axial transmission line communicating at one end with said resonant cavity, said transmission line comprising an inner wall forming member having an end remote from said resonant cavity and an outer wall forming member which members together define an annular hole leading away from said resonant cavity, a tuning plunger movable toward and away from said end of the inner wall forming member whereby to vary the operating frequency of the device over a selected range of frequencies, said outer wall forming member extending beyond said end of the inner wall forming member to receive at least a portion of said plunger and a sealing bellows connecting said plunger with said outer wall forming member and defining therewith a chamber which may produce a range of spurious resonances as said tuning plunger is moved, the improvement wherein:

said outer wall forming member opens out beyond said end of the inner wall forming member to define an enlarged chamber housing said sealing bellows; and a choke is provided to inhibit coupling of r.f. energy into said chamber, said choke comprising a disc-like annular member within said chamber extending transversely with respect to said transmission line and centered with respect to said annular hole adjacent the region whereat said outer wall forming member opens out to define said chamber, said choke being dimensioned such that very little r.f. current appears at the outer edge thereof whereby to inhibit r.f. energy from being coupled into said chamber.

8. In a resonant cavity device as defined in claim 7 wherein said choke has a major radius substantially equal to $\lambda/4$ where $\lambda$ is the wavelength of the said frequency of said selected range.

9. In a resonant cavity device as defined in claim 8 wherein said device is a magnetron having a plurality of resonant cavities and said transmission line communicates with two adjacent resonant cavities.

* * * * *